United States Patent [19]

Koller

[11] 4,126,936

[45] Nov. 28, 1978

[54] IDENTIFICATION SYSTEM FOR POINT TO POINT WIRING

[76] Inventor: Joseph A. Koller, 1900 Old Willow Rd., Northfield, Ill. 60093

[21] Appl. No.: 837,687

[22] Filed: Sep. 29, 1977

[51] Int. Cl.[2] ..... H01R 43/00

[52] U.S. Cl. ..... 29/628; 29/751; 72/410; 101/4

[58] Field of Search ..... 101/3 R, 4, 32; 29/628, 29/751; 72/410; 339/276 T

[56] References Cited

U.S. PATENT DOCUMENTS

| | | | |
|---|---|---|---|
| 2,227,569 | 1/1941 | Brooks | 101/4 |
| 2,250,567 | 7/1941 | Bates | 101/4 |
| 2,517,493 | 8/1950 | Kingsley | 101/4 |
| 2,720,163 | 10/1955 | Shukal | 101/4 |
| 3,894,731 | 7/1975 | Evans | 101/4 |
| 3,955,044 | 5/1976 | Hoffman et al. | 29/628 |

*Primary Examiner*—Lowell A. Larson
*Attorney, Agent, or Firm*—Edmond T. Patnaude

[57] ABSTRACT

Terminal lugs are crimped on the ends of electric wires and simultaneously embossed with selectable alphanumeric characters to facilitate identification of the wires after assembly thereof into harnesses or the like.

7 Claims, 6 Drawing Figures

IDENTIFICATION SYSTEM FOR POINT TO POINT WIRING

The present invention relates in general to the art of electric wiring, and it relates more particularly to a new and improved method and apparatus wherein terminal lugs are crimped onto electric wires and selectable alphanumeric characters are embossed onto the lugs during the crimping operation.

BACKGROUND OF THE INVENTION

In order to facilitate the identification of the individual wires in a multiple wire conduit or harness it has been a common practice to color code the plastic insulation on the wires. The usefulness of such color coding is, however, limited to relatively small numbers of wires, and this identification method frequently leads to wiring errors because of the inability of many persons to distinguish between particular colors. Identification information printed on the wires is also used for this purpose, but the information is difficult to read.

Another method which has been used to identify electric wires is to affix small, individually coded tags to the wires. This method has the major disadvantage of being time consuming, and moreover, inadvertent removal of the tags or obliteration of the printed symbols on the tags is a problem.

When making up a wiring harness or the like it is common practice to affix terminal lugs or connectors to the ends of the wires by a crimping operation. The terminals or connectors ordinarily include a generally tubular metal portion for receiving the stripped end of a wire and an overlying insulating sleeve formed of a plastic material to provide an insulating covering for the tubular portion of the terminal or connector. When preparing each individual wire, the insulation is stripped from the ends and the exposed metal core at one end of the wire is inserted into the tubular end of a terminal. The thus assembled pieces are placed between the opposing jaws of a crimping tool which is then actuated to flatten out and otherwise compress the tubular portion of the terminal to lock it onto the wire and to make a good, low-ohmic connection between the wire and the terminal. In this crimping operation the plastic sleeve is also flattened out and thereafter retains the flattened configuration.

SUMMARY OF THE INVENTION

Briefly, in accordance with one aspect of the present invention the jaws of a crimping tool are provided with selectable alphanumerically shaped embossing recesses so that when a terminal is crimped onto an electric wire alphanumeric identifying characters are simultaneously embossed on the plastic sleeve portion of the terminal. By embossing the same identifying characters on the terminals at both ends of each wire, the different wires in a harness can be readily identified by visual inspection of the terminals. Inasmuch as the identifying characters are raised, they are not very susceptible to collecting dirt or grease thereon, and are easily cleanable by wiping.

When using the method of the present invention, a terminal member is simultaneously crimped onto a wire and embossed with one or more coded characters selectable by the assembler. The same coded characters are embossed on another terminal member as it is crimped onto the other end of the same wire. The time required to mark identifying indicia on the wires is thus minimal inasmuch as the identification step is incorporated into an otherwise necessary operation. Moreover, the previously required inventory of differently color coded wires and/or identification tags is eliminated because the terminals and wires may all be identical prior to assembly.

GENERAL DESCRIPTION OF THE DRAWINGS

The present invention may be better understood from a reading of the following detailed description thereof taken in connection with the accompanying drawing wherein.

DETAILED DESCRIPTION OF THE INVENTION

Figure 1:
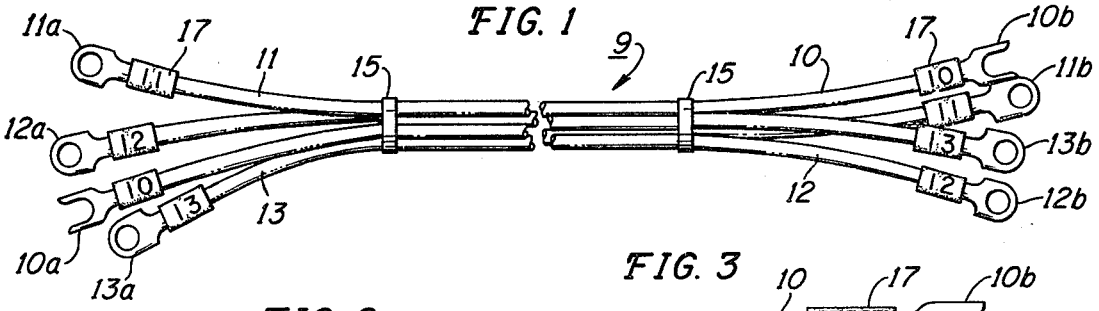
FIG. 1 is a fragmentary view of a point to point wire harness made up of a plurality of conductors which are individually coded in accordance with the present invention.

Referring to FIG. 1, there is shown a wire harness 9 made up of a plurality of flexible electric wires 10, 11, 12 and 13. The wires are conventional and each includes a metallic conductive core and an outer insulating sleeve of plastic. As shown, the wires are held together in the harness by means of a plurality of wrap-around ties 15.

Figure 2:
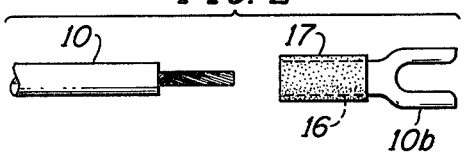
FIG. 2 shows a stripped wire end and a terminal prior to assembly.

A plurality of terminals are secured to the respective ends of the wires 10–13. The terminals are identified by the number of the wire to which they are connected and the suffix *a* for the terminals at the left and the suffix *b* for the terminals at the right. These terminals are conventional and may be open or closed ended as shown. As shown in FIG. 2 they include a generally tubular metallic portion 16 and a plastic sleeve portion 17 overlying the tubular metallic portion.

The terminals are affixed to the ends of the wires 10–13 in a crimping operation wherein the tubular metallic portion 16 and the enclosed metallic core of the wire are flattened out to provide a good, low conductive connection between the wire and the associated terminal. Simultaneously with the crimping operation the sleeve portion 17 is embossed with an identifying alphanumeric character. As shown, the terminals attached to the two ends of the wire 10 are embossed with an identifying alphanumeric character. As shown, the terminals attached to the two ends of the wire 10 are embossed with the number 10, the terminals attached to the two ends of the wire 11 are embossed with the number 11 and so on. As more fully described hereinafter, the sleeves 17 are formed of a plastic such as Nylon which retains its shape after the crimping operation wherefor the coding characters are permanently embossed on the terminal sleeves 17. The coding characters, being embossed on the plastic sleeves, are readily visible and can be easily cleaned if necessary.

Figure 4:
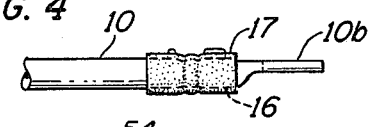
Figure 5:
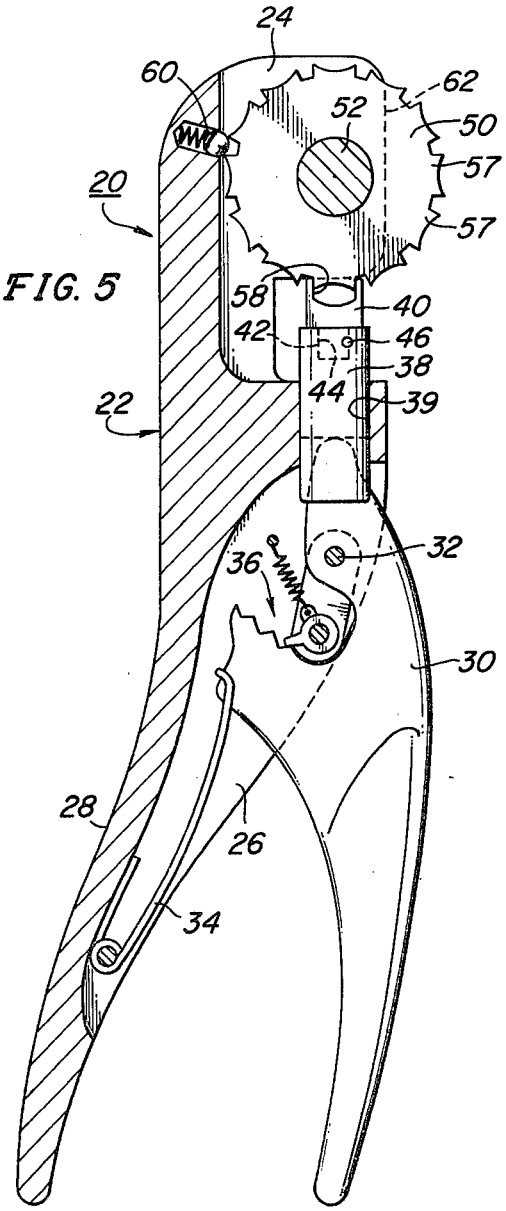
FIG. 5 is a side view, partially sectioned, of a combination crimping and code embossing tool embodying another aspect of the present invention.
Figure 6:
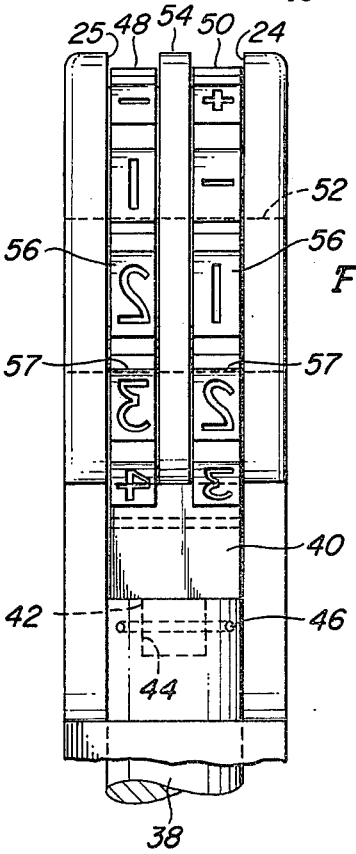
FIG. 6 is a view of the upper portion of the tool of FIG. 5 looking from the right as shown in FIG. 5.

Referring to FIGS. 5 and 6, there is shown a hand operated crimping tool 20 which may be used in carrying out the method of the present invention. The tool 20 includes a body member 22 provided with a pair of parallel longitudinal slots 24 and 25 at the top and a longitudinal slot 26 near the bottom. The body member 22 has a first handle portion 28 and a second handle member 30 is partially disposed in the slot 26 and pivotably attached to the member 22 by a pin 32. A spring 34 is also disposed in the slot 26 and biases the handle member 30 into the open position as shown in FIG. 4. A conventional detent mechanism 36 as more fully described in U.S. Pat. No. 3,611,782 is provided to hold the handle member 30 in an intermediate position.

A jaw member 38 is slidably mounted in a hole 39 in the part 28 and is pinned to the upper end of the handle member 30 so as to be pushed upwardly when the handles 28 and 30 are squeezed together. A compression die 40 has a shank portion 42 which depends into a hole 44 in the upper end of the jaw 38 and is held in place by a conventional locking pin 46.

A pair of embossing die wheels 48 and 50 are positioned in the slots 24 and 25 above the die 40 and rotatably mounted on a journal rod 52. The die wheels 48 and 50 may be identical and are spaced apart by an annular spacer portion 54 integral with the body member 22. These die wheels each have a plurality of embossing die faces 56 respectively provided with recesses complimentary in shape to the coding characters to be embossed on the terminal sleeves 17. Each of the die faces is provided on a section 57 which extends radially outwardly of the die member and which slidably fits into a crimping groove 58 in the upper face of the lower die 40. The die wheels 48 and 50 are independently rotatable to select the particular coding characters desired, and a pair of spring detents 60 lock the dies 48 and 50 in the selected positions.

As may best be seen in FIG. 4, the die wheels 48 and 50 extend a substantial distance forwardly of the front upper side 62 of the body member 22 so as to be easily engaged by the thumb of the operator for rotation into the selected positions.

OPERATION

Figure 3:
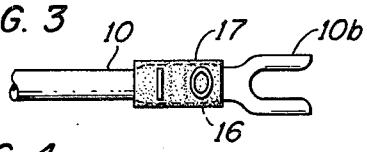
FIGS. 3 and 4 are top and side views of a terminal after crimping and coding using the method of the present invention.

When practicing the method of the present invention, a wire to be coded has the insulation stripped from one end, as shown in FIG. 2, and the exposed metallic core is inserted into the tubular metallic portion of the terminal member. The sleeve portion of the terminal member is then placed in the slot 58 of the die member 40 and the handles 28 and 30 are squeezed together to compress the terminal sleeve 17 between the die 40 and the die faces 56. This single operation compresses the terminal sleeve and the wire core together to crimp the two together and it simultaneously embosses on the plastic sleeve 17 the particular characters on the die surfaces 56 positioned above the die 40 as shown in FIGS. 3 and 4. The other end of the wire is also stripped and without changing the positions of the die wheels 48 and 50 a terminal is crimped onto the other end of the wire. In this manner the terminals at both ends of the wire have the same characters embossed thereon. The die wheels can then be reset and the tool 20 used to crimp and code the terminals to another wire.

The present invention thus provides a novel method and tool for applying identifying indicia to electric wires having terminals or connectors provided thereon. While the invention is described in connection with a hand tool for crimping and embossing the terminals it will be understood by those skilled in the art that other crimping apparatus may be used for this purpose where it is economically expedient to do so.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A method of applying identifying indicia to an electric wire, comprising the steps of inserting one end of said wire into the hole in a tubular end portion of a metallic terminal member having a plastic sleeve overlying said tubular end portion, placing said tubular end portion between a pair of crimping dies wherein one of said dies has an embossing surface having in the face thereof a recess in the shape of an alphanumeric character, moving said dies towards one another to compress said wire, said tubular end portion and said sleeve between said dies to crimp said terminal onto said wire and simultaneously to emboss said alphanumeric character on said plastic sleeve.

2. A method of applying identifying indicia to an electric wire, comprising repeating the steps of claim 1 to apply the same alphanumeric character to two terminals respectively connected to the two ends of said wire.

3. A tool for simultaneously crimping a terminal to an electric wire and embossing an alphanumeric character on said terminal, comprising a body member, a first die having a plurality of die faces thereon, each of said die faces being contoured in the shape of a different alphanumeric character, means mounting said first die to said body member to enable selected movement of said die faces into an operating position, a second die mounted to said body member for reciprocable movement toward and away from the one of said die faces disposed in said operating position, and means for moving said dies together simultaneously to crimp and to encode with an alphanumeric character the surface of said terminal disposed between said dies.

4. A tool according to claim 3 comprising a third die having a plurality of die faces thereon, said die faces on said third die being contoured in the shape of a different alphanumeric character, and means mounting said third die to said body member to enable selected movement of the die faces thereof into an operating position opposite said second die, whereby movement of said second die toward said first die encodes selectable alphanumeric characters on said first and third dies.

5. A tool according to claim 3 wherein said first die comprises a wheel rotatably mounted to said body member.

6. A tool according to claim 5 wherein said die faces are disposed on the peripheral edge of said wheel.

7. A tool according to claim 6 comprising a second wheel rotatably mounted to said body member for rotation on the axis of said first wheel, said second wheel having a plurality of alphanumerically contoured die faces on the peripheral edge thereof.

* * * * *